United States Patent [19]

Skolnik et al.

[11] Patent Number: 5,026,431

[45] Date of Patent: Jun. 25, 1991

[54] PROCESS OF KOSHERING CONTAINERS

[75] Inventors: Howard Skolnik, Chicago, Ill.; Paul R. Dukes, Jr., Maunee, Ohio; Jonah Gewirtz, Silver Spring, Md.

[73] Assignee: Skolnik Industries, Inc., Chicago, Ill.

[21] Appl. No.: 348,803

[22] Filed: May 8, 1989

Related U.S. Application Data

[63] Continuation-in-part of Ser. No. 131,291, Feb. 8, 1987, Pat. No. 4,830,675, which is a continuation of Ser. No. 872,016, Jun. 9, 1986, abandoned.

[51] Int. Cl.[5] ..... B08B 7/00

[52] U.S. Cl. ..... 134/3; 134/2; 134/36; 134/40; 134/41; 432/124; 432/225; 110/236

[58] Field of Search ..... 134/2, 3, 40, 36, 41, 134/20; 252/110; 432/124, 224, 2, 59, 75; 110/236

[56] References Cited

U.S. PATENT DOCUMENTS

| | | | |
|---|---|---|---|
| 284,016 | 8/1883 | Hynson | 432/224 |
| 422,496 | 3/1890 | Sherman | 432/224 |
| 433,876 | 8/1890 | Oncken | 432/224 |
| 954,623 | 4/1910 | Grahn | 432/224 |
| 1,052,512 | 2/1913 | Phillips | 432/224 |
| 1,125,930 | 1/1915 | Arnemann | 432/224 |
| 2,194,433 | 3/1940 | Schorck | 432/224 |
| 2,294,168 | 8/1942 | Francis et al. | 432/224 |
| 3,050,297 | 8/1982 | Walter | 432/224 |
| 4,830,675 | 5/1989 | Skolnik | 134/3 |
| 4,906,301 | 3/1990 | Skolnik | 134/3 |

*Primary Examiner*—Asok Pal

*Attorney, Agent, or Firm*—Milton S. Gerstein; Marvin N. Benn

[57] ABSTRACT

A process for koshering relatively large metallic containers used to store and transport kosher foods includes the steps of washing and rinsing the interior of the container to remove surface oils and greases, treating the interior surface of the container with a rust inhibitor, flame treating the interior surface to drive off any impregnated oils, greases or dirts and, optionally, spraying the interior of the container with a kosher epoxy/-phenolic compound and thereafter curing the compound by the application of heat. The resulting container may be used to store and transport food stuffs certified to have been prepared in accordance with the kosher dietary laws. An oven for carrying out this process is also disclosed.

19 Claims, 2 Drawing Sheets

PROCESS OF KOSHERING CONTAINERS

CROSS-REFERENCE TO RELATED APPLICATION

This is a continuation-in-part application of application Ser. No. 07/131,291, filed Dec. 8, 1987, and now U.S. Pat. No. 4,830,675, which is a continuation of application Ser. No. 06/872,076, filed Jun. 9, 1986, now abandoned.

BACKGROUND OF THE INVENTION

The present invention relates generally to the processing of manufactured metallic containers and, more particularly, to a process whereby metallic storage containers are processed to allow foods prepared in accordance with the dietary laws of koshering to be stored and transported while retaining the kosher integrity of the food.

The strict dietary laws by which it is determined that foods are kosher require total abstinence from certain foods, prohibit the mixing of certain types of food on a single plate or at a single meal, and also prescribe the manner in which an animal, in order to be considered kosher, must be raised, butchered, and cooked. For example, according to Mosaic Law, certain foods such as pork products and shrimp are inherently not kosher and cannot be prepared to render them kosher. It is also a requirement of the dietary laws that meat dishes and dairy dishes cannot be consumed together, so that otherwise kosher foods, if improperly combined in a single meal will render the meal non-kosher even though the individual components themselves are prepared according to the laws of kosher.

When a vessel, such as a cooking pot, is used to prepare a meat dish, and must thereafter be used to prepare a dairy dish, the vessel must be cleaned thoroughly enough to remove all vestiges of the previously prepared meat dish, such as by the use of boiling water, steam, or flame drying. To my knowledge, there has been no practical method developed to date to adapt such a koshering process to large-volume containers, such as 55 gallon drums. If, for example, the food to be stored is "dairy" in nature, the presence of any contaminant traceable back to a "meat" origin may destroy the kosher character of the food. In like fashion, any "non-kosher" contaminant may also produce the same result.

Problems can then arise when, after food has been prepared in a kosher manner, it is stored in such a way that the storage vessel becomes a vehicle for contaminants which, while not adulterating the food in a medically harmful sense may still contribute contaminants of a character sufficient to destroy the kosher integrity of the food.

As an example, certain metallic containers, such as cans or drums used for the bulk storage and transportation of foods may, during the manufacturing process, may come in contact with, and be coated with a thin film of oil or grease, the presence of which in an otherwise kosher food may destroy the integrity of the koshering process.

Foods prepared in accordance with the dietary laws are certified as kosher by one trained to observe the entire manufacturing process and determine whether the method of preparing the food and the individual ingredients are consistent with the practice and observance of the dietary laws. In much the same manner, the same determination must be made with respect to the preparation of packaging for the food so prepared.

One of the objects of the present invention is to provide a process whereby the carrying out of the process will render a container fit for the storage and transportation of kosher foods without requiring that each such container be chemically tested or inspected to assure that all contaminants have been removed. It thus becomes unnecessary to determine whether or not the particular adulterant present would render any food in the container non-kosher: It is enough that the process remove all such adulterants, whatever their nature.

There is known as part of the prior art a number of issued United States patents which relate to the cleaning and treatment of vessels, although no such reference addresses the particular problems inherent in the koshering of such vessels.

U.S. Pat. No. 2,383,470, issued to Morgan on Aug. 28, 1945 describes methods and apparatus for cleaning and surface coating a glass, metallic, or other support surface to which a reflective layer is to be added. The problem addressed by Morgan is the cleaning of the surface and the maintaining of the surface in a clean condition so that the later-applied reflective coating will not "pit". To accomplish this, Morgan teaches the washing of the surface in question with a mineral acid solution, rinsing the surface with distilled water, treating the surface with a flame such as a gas burner, and exposing the surface to the vapors of a suitable organic liquid to produce a protective film on the cleaned surface. The deposited vapor layer is intended to keep the surface clean until the permanent coating is applied. Morgan also discloses a permanent coating a metallized layer intended to impart light-reflecting capabilities to the finished article. Before applying the permanent coating, the vapor deposited organic coating must first be removed.

U.S. Pat. No. 4,136,217 to Henley teaches and describes a continuous process for the removal of oil emulsions from metallic surfaces by washing the surfaces with a mixture of wash water and demulsifier to break up and remove the oil.

U.S. Pat. No. 3,522,093 issued to Wolman on Jul. 28, 1970 teaches the purging and cleaning of the tube surfaces of the tube-and-shell reactors by circulating a cleaning solution through the tubes, purging the tubes with nitrogen, circulating a second solution to passivate clean surfaces and again purging the tubes with nitrogen and retaining nitrogen in the tubes until the tubes are ready for use.

U.S. Pat. No. 3,132,975 issued to Freud issued on May 12, 1964 teaches yet another passivating technique for the metallic surfaces of reactor tubes.

U.S. Pat. No. 3,030,238, issued to Cohn on Apr. 17, 1962 teaches a method for treating metal surfaces involving cleaning the surface to degrease it, rinsing the surface with water and applying a thin residual film on the metal surfaces so cleaned in order to passivate them.

U.S. Pat. No. 4,169,187 issued to Glazer on Sept. 25, 1979, and U.S. Pat. No. 4,163,812 issued to Coucher on Aug. 7, 1979 both teach the coating of cylindrical containers with resinous or epoxy-resinous coatings.

The above mentioned patents do not address the problems inherent in the preparation of a container for the storage and transportation of kosher foods and the techniques and process involved would raise other problems in considering the koshering packing of foods. As an example, the temporary passivating of a metallic surface with a substance intended to thereafter have to be removed may raise a question as to whether or not enough of the substance has been removed in order to render the container safe for kosher packaging.

Accordingly, the need exists for a manufacturing process of treatment which may be applied to and used upon metallic food storage containers to assure that kosher foods placed in such containers will contain their kosher character by avoiding contaminants encountered during the manufacture of the container.

SUMMARY OF THE INVENTION

There is disclosed herein, in varying scope, a process for the koshering of a manufactured metal container, with the process being intended to put the interior of the container into a proper condition for accepting and storing food prepared according to the kosher dietary laws while maintaining the integrity of the food preparation process. A preferred embodiment of the process includes the following steps:

(1) Washing the interior surface of the metal container with an alkaline wash or cleanser at high enough temperature and for a period sufficient to effect removal of any grease, oil or similar contaminants therefrom;

(2) Rinsing the interior of the container with fresh water for a time sufficient to flush away any remaining cleanser:

(3) Coating the interior surface of the container with a rust inhibitor;

(4) Flame-drying of the interior surface of the container at a sufficient temperature to remove any impregnated oil from pores in the container surface;

(5) Spraying the interior surface of the container with an epoxy-phenolic composition to provide a kosher surface coating; and (6) Baking the epoxy-phenolic coating until the coating is cured.

Also disclosed is an oven used in carrying out the flame-drying step of the process of the invention.

BRIEF DESCRIPTION OF THE DRAWINGS

The invention will be more readily understood with reference to the accompanying drawing, wherein.

DETAILED DESCRIPTION OF THE INVENTION

Figure 1:
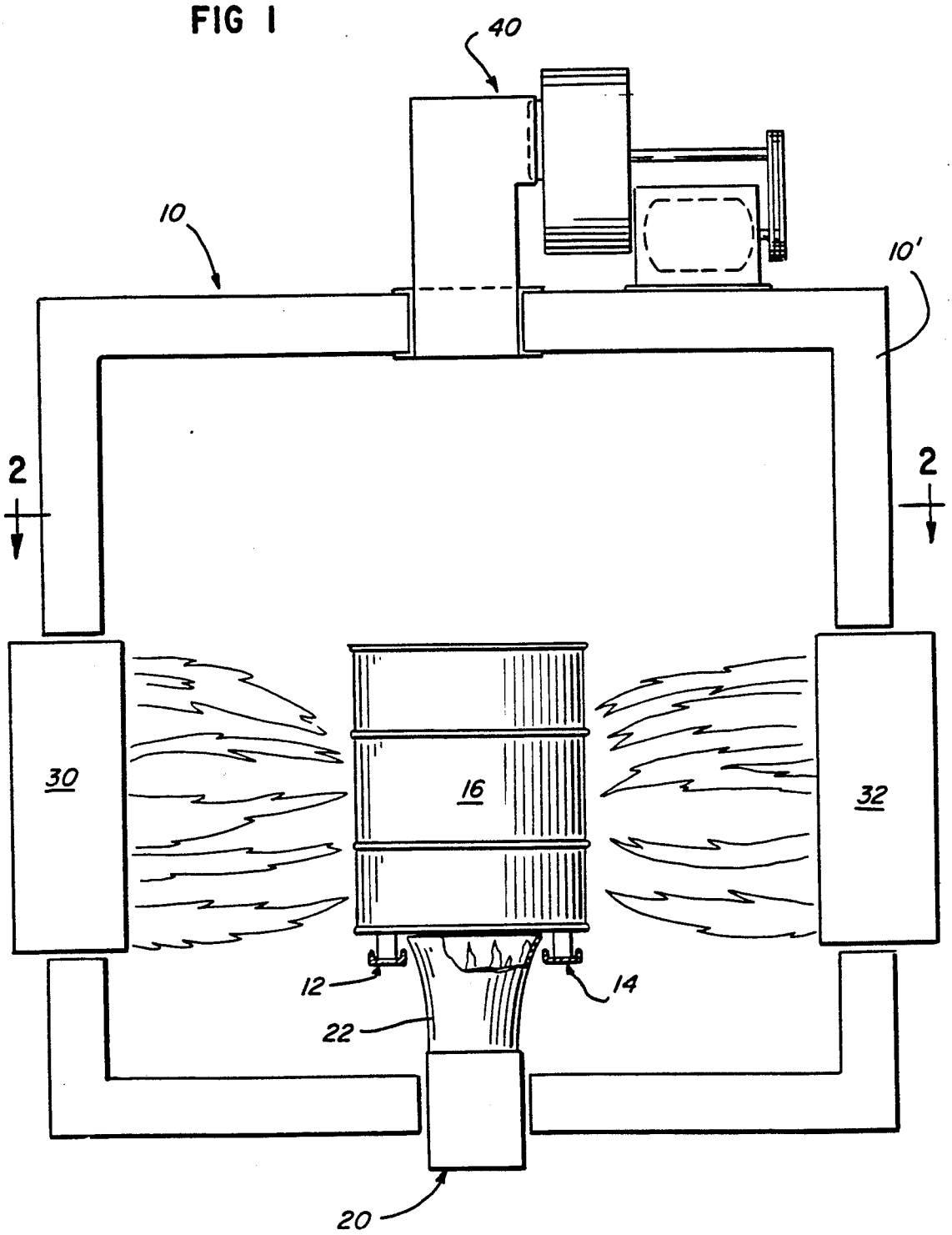
FIG. 1 is a cross-sectional view, in elevation, of the oven of the invention for carrying out the flame-drying method step according to the invention.

While use of the processes and techniques disclosed herein may be extended to containers of varying sizes and configurations, a preferred use of the presently-described process is directly primarily to relatively large containers, such as steel drums having a capacity of about 55 gallons. Such drums are typically cylindrical in shape and have lids which may be either strapped, crimped, or otherwise attached to close off the drum. Access to the drum may thereafter be had by removing the lid or through a hole or port formed in the lid.

A preferred embodiment of the present invention features the movement of a metallic drum, intended to be rendered fit for the storage and transportation of kosher foods past various processing stations, utilizing well-known techniques of material handling and transportation, such as conveyor belts and the like. The individual stations involved in the process are each specially modified to accommodate the operation carried out at each station and the material being applied to the drum at each station.

A drum selected for treatment will be transported to a first station whereat the interior of the drum is washed with an aqueous solution of a selected detergent or detergents for the removal of any residual grease or oils remaining in or on the steel used to manufacture the drum. One such detergent found to be of particular effectiveness is sold under the tradename "Liquid Ferro-Terj", manufactured by the DuBois Chemical Company of Cincinnati, Ohio. It has also been found, in order to be even more effective, the washing operation should be carried out at a water temperature at or in excess of 160° F.

Most commonly, the greases or oils to be removed will have been applied to the steel while it is still in a flat, sheet configuration prior to manufacturing and may also include dirts, oils, greases, and other surface contaminants encountered during the manufacture, storage, shipment and handling of such flat sheet steel. The present process for producing a kosher container also contemplates the purchase of steel in sheet form and the manufacturer of the drum itself such that every detail of the manufacture and koshering process is carried out in a single facility and such that each step of manufacture and treatment is monitored.

The first, or washing station should preferably include means for the recovery, treatment and recycling of the wash water and the possible separation therefrom of the grease removed from the manufactured drum.

The newly washed drum next will be transferred to a second or rinse station where water is used to remove any remaining vestiges of detergent ad contaminant. In order to increase the efficiency of the rinse process, a sheeting agent or wetting agent is used in connection with the rinse water. One such agent found to be effective is sold under the tradename "Dry-It", manufactured by the DuBois Chemical Company of Cincinnati, Ohio. It has also been found in order to be effective, the rinsing operation should be carried out at a temperature at or in excess of 90° F. As with the wash station, the rinse station should preferably include facilities to capture and recirculate the rinse water utilized, if desired, as well as facilities to separate out the contaminants removed in the rinse water.

At the third, or rustproofing station, a rust inhibitor is applied to the interior surface of the drum in order to prevent the formation of rust on the newly-cleaned and exposed metallic interior surface of the drum. One rust inhibitor found to be of particular utility is sold under the trade designation "R-A-573" by Chemical Systems, Inc. of Chicago, Ill. The application of the rust inhibitor is preferably carried out for about three minutes at a temperature of about 160° F.

Figure 2:
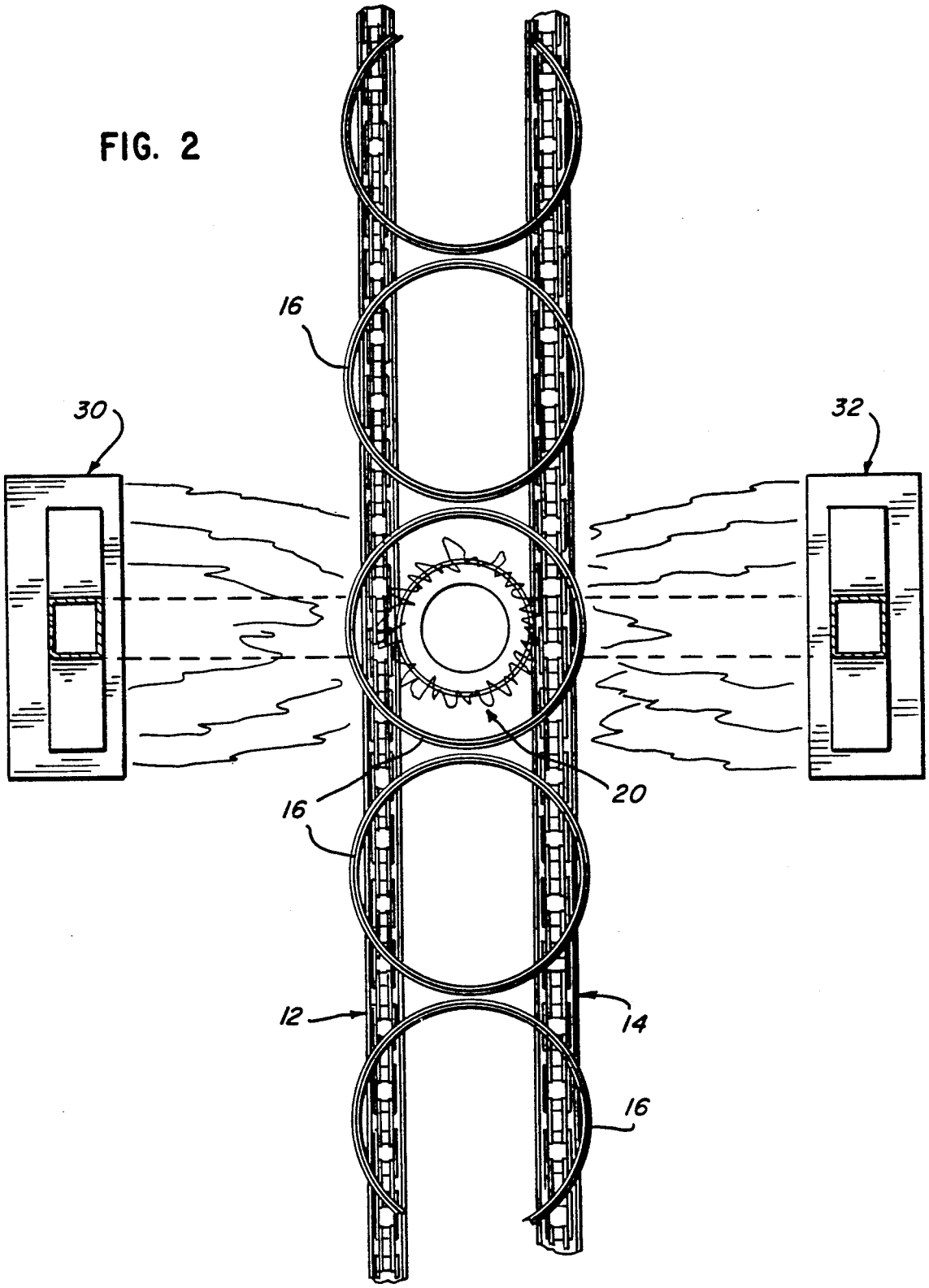
FIG. 2 is a cross-sectional view taken along line 2—2 of FIG. 1.

After the drum has thus been washed and rinsed, it is transported to a fourth station for flame-treatment of the interior surface. An open flame is used and is desirable in driving out any remaining contaminants which may have infiltrated the porous surface of the sheet steel used to form the drum. Such flame treatment is a typical step in the koshering of cooking vessels used to prepare different types of foods at different times, the combination of which in the same vessel would produce a non-kosher food mixture. Again, the flame-drying should be carried out for a sufficient length of time to assure that any such entrained contaminants, whether or not detectable to the human eye, be removed. FIGS. 1 and 2 show the oven of the invention for carrying out the flame-drying step. The over 10 of the invention has a six-inch thick insulating wall 10' through which pass a pair of horizontal chain-conveyors 12, 14 upon which drums 16 are conveyed into, through, and out of the oven 10. The drums are oriented on the conveyor-chains height-wise, such that the hollow interior of the drum is vertically oriented. The drum 16, at the stage shown in FIG. 1, has no bottom, so that the interior of the drum is completely hollow from end to end and accessible from below. The bottom lid is provided on the drum 16 in the conventional manner, after the koshering process has been completed for the basic drum 16. It is to be understood that the bottom lid or base of the finished drum is also subject to the same koshering process as the basic drum 16 described herein. For the bottom lid or base, however, a simple conveyor is used, with each flat surfaces of the base being exposed to a flame from a burner, such as those shown in the figures. The hollow interior of the drum is accessible from below. Interposed between the pair of conveyor-chains, approximately midway along the depth of the oven 10, is a first flame-burner 20, such as that manufactured by Maxon Corp. of Munsey, Ind. model number "415 OVERPAK". This burner has an 8 inch circular barrel cone from which the flames project, so that such flames spiral outwardly therefrom and upwardly into the hollow drum interior through the lower open mouth thereof. The burner 20 is mounted in a lower central section of the over wall 10, as shown in FIG. 1. A flame-shroud 22 is provided that extends from the barrel cone of the burner 10 upwardly between the two conveyor-chains 12, 14, to a level just below the upper surfaces of the chains, in order to protect the conveyors from the flames. The oven 10 is also provided with a pair of laterally positioned burners 30, 32, mounted on diametrically-opposed portions of the oven wall 10', as shown in FIGS. 1 and 2, for flame-treating the outer circumferential surface of a drum 16 for rendering the oils, fats, and the like, thereon into ash. The burners 30, 32 may be that manufactured by Eclipse Inc. of Rockford, Ill. model number 240AH. In the preferred embodiment, the burners 30, 32 are spaced approximately 72 inches apart, so that for a standard 55 gallon drum, each burner 30, 32 is spaced approximately 24 inches from a respective outer circumferential portion of the drum. The burners 30, 32 and 20 are flame-adjustable whereby the heat produced and projections of the flames are adjustable, so that variously-sized drums and containers may be accomodated, and so that the heat applied and time-duration of the flame-drying method step may be suitably and accordingly varied. The oven 10 is also provided with a conventional exhaust fan assembly 40 at in upper section of the wall 10'. Each of the burners 30, 32 provides a flame that spreads outwardly, so that one-half of the outer circumferential surface of the basic drum 16 is exposed to the flames, thereby exposing the entire outer circumference of the drum to flames via the two burners 30, 32. Each burner 30, 32 is between 24 inches and 48 inches, so that the largest drum, the 55 gallon, is easily accomodated along the entire height thereof with each burner 20, 30 and 32 also providing a 3-foot wide burner-flame. It is, of course, within the scope and purview of the invention to provide additional burners similar to the burners 30, 32 on the other portions of the outer wall of the oven in order to ensure that a more thorough flame-exposure of the entire circumferential surface of the drum 16 is achieved. Each of the burners 20, 30, 32, as mentioned above, has an adjustable flame, with the range of temperatures of the flames from any one burner being between 600 degrees F. and 1300 degrees F. In the preferred embodiment, the length of flame-exposure of the hollow interior of the drum to the flames of the burner 20 is between two seconds for the upper range of temperature, and up to 30 seconds for the lower range thereof, it being understood that the flame-temperature and flame-exposure time is variable depending upon the size of the drum or container, preferred operating temperature of the flames of the burner 20, capacity of the conveyor system and the speed thereof, and the like. The flame-exposure and flame-temperature of the outer circumferential surface to the flame-burners 30, 32 is also preferably the same as that of the inner surface in connection with the flame-burner 20. In the preferred embodiment, this process step may be used alone without any other stated herein, except for, perhaps, washing or rinsing after said step of flame-drying, the flame-drying step alone, in most cases and circumstances, providing a kosher container according to Jewish law, with the washing and rinsing removing the ash, burned residue, and the like. The washing and rinsing after the step of flame-drying may be the same as the first and second steps performed at the first and second stations, so that after the step of flame-drying, the flame-treated drum may thereafter be returned to the very same first and second stations. Alternatively, the flame-treating step may be carried out first, with the washing and rinsing steps carried out thereafter. What is essential is that the step of flame-treating the interior of the drum. be carried out, with the washing and rinsing, as well as third rust-proofing step, although desirable, being optional before the flame-treating step, as well as after, though for all intents and purposes, washing and rinsing after the step of flame-treating is preferred in order to rid the interior of the drum from ash, etc., as explained above. The last, coating step, described below, is also optional, and may be eliminated.

At the fifth processing station, an epoxy/phenolic composition is applied to the inner surface of the drum in order to produce a kosher coating. The particular epoxy/phenolic combination is selected to be kosher within the dietary laws, and one such phenolic coating found effective is sold under the trade designation "285-C-124 (tan color)" or "285-R-114 (dark brown color)" by the Valspar Corporation of Baltimore, Md.

At the last processing station, the drum is baked at a temperature of about 425° F. until the epoxy/phenolic coating is fully cured.

The above-described process forms an integral part of the manufacturing and distribution chain of kosher foods. Manufacturers of such foods must verify that the foods are in a kosher condition upon final preparation. Thereafter, the kosher character and quality of the container itself must also be certifiable in order to assure that subsequent storage and transportation of the foods will not compromise its kosher character and quality.

While the foregoing has presented a specific preferred embodiment of the invention disclosed herein, it is to be understood that this embodiment has been presented by way of example only. It is expected that others will perceive variations which, while differing from the foregoing, do not depart from the spirit and scope of the invention as herein described and claimed.

What I claim is:

1. A process for koshering metallic food storage containers, said containers manufactured from flat sheet steel on whose interior surface oils, greases, and dirt are suspected of being present, said process comprising:

conveying a series of containers through an oven having first flame-burner means and second flame-burner means, said step of conveying comprising exposing the interior surface of each container to the flames of the first flame-burner means, and exposing the exterior surface of each container to the flames of the second flame-burner means, for removing oils, grease and other contaminants entrained within the pores of and on the interior and exterior surfaces.

2. The process according to claim 1, wherein the first and second flame-burner means are positioned substantially at the same station along the conveyance of the containers through the oven, said steps of exposing being performed substantially at the same time.

3. The process according to claim 1, wherein said step of conveying comprises passing each container along a substantially linear path through the oven.

4. The process according to claim 2, wherein said step of conveying comprises passing each container along a substantially linear path through the oven.

5. The process according to claim 1, wherein said step of conveying comprises supporting the lower circumferential rim of each container on two horizontally spaced-apart conveyer elements, so that each container is vertically upright; and moving the containers in a first direction toward the first flame-burner means, said step of exposing the interior surface of each container comprising mounting the first flame-burner means in the oven in a position between the two conveyer elements.

6. The process according to claim 1, wherein said step of exposing the interior surface of each container comprises shrouding the flames from the first flame-burner means in order to provide protection from the flames, said step of shrouding comprising encircling the flames from the first flame-burner means with a shroud-covering having an open mouth through which open mouth the flames of the first flame-burner means exit to enter into the hollow interior of the container.

7. The process according to claim 5, wherein said step of exposing the interior surface of each container comprises shrouding the flames from the first flame-burner means in order to provide protection from the flames, said step of shrouding comprising encircling the flames from the first flame-burner means with a shroud-covering having an open mouth through which open mouth the flames of the first flame-burner means exit to enter into the hollow interior of the container.

8. The process according to claim 1, wherein said step of exposing the exterior surface comprises providing flames from the second flame-burner means having a vertical height that is approximately equal to the height of each container; said step of exposing the exterior surface comprising mounting two second flame-burners on opposite sides of the two conveyor elements, so that the flames from one of the second flame-burners contacts a first half of the exterior surface of each container passing therepast substantially along the entire height of the container, and the flames from the other of the second flame-burners contacts the second half of the exterior surface of each container passing therepast substantially along the entire height of the container.

9. The process according to claim 8, further comprising:

adjusting the flames of each flame-burner to a desired flame-temperature and flame-projection, so that different sizes of containers may be processed and flame-drying times altered.

10. The process according to claim 1, further comprising:

adjusting the flames of each flame-burner means to a desired flame-temperature and flame-projection, so that different sizes of containers may be processed and flame-drying times altered.

11. The process according to claim 1, further comprising:

washing the interior of said container with a degreasing detergent in an aqueous solution before said step of conveying;

rinsing the interior of said container with a water wash after said step of washing; and applying to the interior of said container a rustinhibiting substance after said of rinsing.

12. The process according to claim 11, further comprising:

applying to the interior surface of said container an epoxy/phenolic composition containing no non-kosher ingredients after said step of conveying; and applying heat to the interior of said container to cure said epoxy/phenolic coat.

13. A process for koshering metallic food storage containers, said containers manufactured from flat sheet steel on whose interior surface oils, greases, and dirt are suspected of being present, said process comprising:

conveying a series of containers through an oven having a stationary flame-burner, said step of conveying comprising exposing the interior surface of each container to the flames of the flame-burner, for removing oils, grease and other contaminants entrained within the pores of and on the interior surfaces;

said step of conveying comprising passing each container along a substantially linear path through the oven; and said step of conveying further comprising supporting the lower circumferential rim of each container on a conveyer means, so that each container is supported vertically upright; and moving the containers in a first direction toward the flame-burner; said step of exposing the interior surface of each container comprising mounting the flame-burner in the oven in a position substantially along the center of the conveyer means.

14. The process according to claim 13, wherein said step of exposing comprises shrouding the flames from the flame-burner in order to provide protection from the flames, said step of shrouding comprising encircling the flames from the flame-burner with a shroud-covering having an open mouth through which open mouth the flames of the flame-burner exit to enter into the hollow interior of the container.

15. The process according to claim 14, further comprising:

adjusting the flames of the flame-burner to a desired flame-temperature and flame-projection, so that different sizes of containers may be processed and flame-drying times altered.

16. The process according to claim 13, further comprising:

adjusting the flames of each flame-burner to a desired flame-temperature and flame-projection, so that different sizes of containers may be processed and flame-drying times altered.

17. The process according to claim 13, further comprising:

washing the interior of said container with a degreasing detergent in an aqueous solution before said step of conveying;

rinsing the interior of said container with a water wash after said step of washing; and applying to the interior of said container a rustinhibiting substance after said of rinsing.

18. The process according to claim 17, further comprising:

applying to the interior surface of said container an epoxy/phenolic composition containing no non-kosher ingredients after said step of conveying; and applying heat to the interior of said container to cure said epoxy/phenolic coat.

19. The process according to claim 13, wherein said step of conveying comprising supporting the containers on a pair of horizontally spaced-apart conveyer elements, said step of mounting the flame-burner comprising positioning the flame-burner below the conveyer means and between the two conveyer-elements, whereby the flames from flame-burner may project upwardly between the two conveyer elements.

* * * * *